United States Patent [19]

Strew

[11] 4,043,320

[45] Aug. 23, 1977

[54] HOOD ASSEMBLY FOR COOKING RANGES

[75] Inventor: Mitchell Strew, Arlington Heights, Ill.

[73] Assignee: Illinois Range Company, Mount Prospect, Ill.

[21] Appl. No.: 670,751

[22] Filed: Mar. 26, 1976

[51] Int. Cl.[2] ..... F23J 11/00; B01D 47/06

[52] U.S. Cl. ..... 126/299 E; 210/540; 55/DIG. 36; 55/228

[58] Field of Search ..... 98/115 K, 121 R, 115 LH, 98/121 A, 115 R; 126/299 R, 299 A, 299 B; 55/DIG. 36, 260, 421, 228, 242; 210/540, 311, 305, 320

[56] References Cited

U.S. PATENT DOCUMENTS

| | | | |
|---|---|---|---|
| 3,410,195 | 11/1968 | King | 98/115 K |
| 3,433,146 | 3/1969 | Russell | 55/DIG. 36 |
| 3,566,585 | 3/1971 | Voloshen et al. | 98/115 K |
| 3,645,195 | 2/1972 | Koval | 98/121 R |
| 3,682,156 | 8/1972 | Perl | 126/21 A |
| 3,731,462 | 5/1973 | Costarella et al. | 98/115 K |
| 3,731,802 | 5/1973 | James | 210/540 |
| 3,854,388 | 12/1974 | King | 98/115 K |

*Primary Examiner*—William E. Wayner
*Assistant Examiner*—Henry C. Yuen
*Attorney, Agent, or Firm*—Brezina & Lund

[57] ABSTRACT

A compact hood assembly is provided for use with griddles and other types of cooking range units which generate grease-carrying vapors. A vapor treating section overlies the rear part of a range unit to receive vapors into a vapor treating zone into which water is sprayed with grease-carrying water being collected in a trough, and a water treating section is disposed alongside the range unit and includes a tank receiving water from one side of the trough with the water being pumped from the tank to spraying means of the vapor treating section. Important features relate to the construction, disposition and operation of baffle means which extend downwardly and forwardly toward the trough means and which includes spaced vanes, the baffle means including one or more sections which are removable for cleaning and for access to the interior of the vapor treating section. Additional features relate to an arrangement of nozzles in the vapor treating section to spray water forwardly and downwardly over the baffle means and to the provision of shields and baffles within the vapor treating section. Further features relate to the water treating section which includes a top structure positioned to provide a work surface adjacent the range unit and removable to permit cleaning of the tank. Removable baffles and screens are provided in the tank to facilitate grease removal and for maintaining a high degree of cleanliness.

15 Claims, 9 Drawing Figures

HOOD ASSEMBLY FOR COOKING RANGES

This invention relates to a hood assembly and more particularly to a hood assembly for removing grease from vapors generated by griddles and other types of range units with a high degree of safety and efficiency. The hood assembly is readily installed and is compact, permitting maximum efficiency in the utilization of space, and it is easy to maintain and keep clean while being economically manufacturable.

BACKGROUND OF THE PRIOR ART

Various types of arrangements have heretofore been proposed incorporating means for spraying water through gases to remove impurities therefrom and also incorporating means for filtering and recirculating the water. The British patent No. 535,484 is an early example. It has also been proposed to use similar arrangements in conjunction with cooking stoves for removing grease, as disclosed in the Baker, U.S. Pat. No. 3,100,809, for example. More recent developments are disclosed in the Costarella et al U.S. Pat. Nos. 3,628,311 and 3,731,462. The principles of operation of such arrangements have considerable potential importance especially with respect to the removal of grease which presents an environmental problem and also a fire hazard. When properly installed and serviced, they can reduce pollution very substantially and can reduce the likelihood of fire to a great extent. However, the proposed arrangements have not been widely used and have not been accessible to many potential users. The problems arise in part from the high cost of equipment, difficulties in installation, especially where space is at a premium, and difficulties in cleaning and maintenance, particularly where it is not possible to use trained personnel.

Summary of the Invention

This invention was evolved with the general objects of overcoming the disadvantages of prior systems and of providing a system which is economically manufacturable, easily cleaned, serviced and maintained and readily installed and which at the same time is highly efficient in operation. The invention is based in part upon the recognition of problems with the prior proposed systems. One problem is that the systems have been relatively large in size and have required space which is not always available, especially when use is contemplated for existing installations of cooking equipment. Another problem is that portions of the equipment which should be cleaned are not readily accessible and if the equipment is not properly cleaned and maintained, it may not only not function properly, but may create hazardous conditions.

In an assembly constructed in accordance with the invention, grease-carrying vapors rising from a griddle or the like flow into a vapor treatment section in which water is sprayed through the vapors to cool and carry the grease with it into a collection trough. The grease-carrying water flows from the trough into a tank of a water treatment section in which the grease coagulates and separates from the water. The water is recirculated, being pumped from the bottom of the tank back up to the vapor treatment section to be sprayed through the vapors, collect grease and flow back into the tank.

An important feature relates to the arrangement of the vapor and water treatment sections in a unitary structure in which the water treatment section is disposed alongside the range unit with a conduit extending directly from an end portion of the collection trough downwardly to a rear portion of the tank of the water treatment section and with a conduit extending from an outlet of a pump of the water treatment section to one end of a supply pipe extending into the vapor treatment section, the pump being preferably located below the tank with its inlet coupled through an upwardly extending conduit or pipe to the bottom of the tank.

In accordance with specific features, the water treatment section includes a generally rectangular housing with a top wall structure approximately in horizontal alignment with the upper surface of the range unit to provide a work surface adjacent thereto. Preferably, the top wall structure is removable for access to the tank for cleaning and servicing thereof.

Additional features relate to the provision of baffle structures and screens in the tank of the water treatment section, such being preferably arranged for removal to facilitate collection of the grease and also to facilitate cleaning.

Further important features relate to the construction and operation of the vapor treatment section. Baffle means are provided extending angularly downwardly and forwardly from an upper forward support means below the forward end of a top wall structure to a lower support means adjacent the forward end of a trough structure, the baffle means having openings therethrough and being arranged for permitting free flow of vapors into a treatment zone while directing flow of water impinged thereon into the collection trough.

Preferably and in accordance with a specific feature, the baffle means are manually removable forwardly away from the treatment zone for cleaning thereof and for access to the trough and to interior surface portions of the walls of the section. The baffle means includes at least one generally rectangular section having a bottom edge portion adapted to rest on the lower support with a connection including projection and recess means limiting movement of the baffle section. The upper baffle support is arranged to allow upward movement of the bottom edge portion to disengage the projection and recess means and to allow the baffle section to be removed downwardly and forwardly.

Another specific feature relates to the provision of a plurality of spaced parallel horizontally extending vanes in the baffle means. Preferably, each of the vanes may include a generally horizontal portion and a rear portion projecting angularly downwardly and rearwardly from the rearward edge of the horizontal portion with a forward portion projecting upwardly and forwardly from the forward edge of the horizontal portion. This arrangement promotes free flow of vapors into the treatment zone while preventing any water or water droplets from dropping down onto the range unit.

Additional features relate to an arrangement which permits flue gases from the range unit to flow upwardly behind the trough structure and into the vapor treatment zone with a suitable shield being provided to prevent water from entering the path of flow of flue gases.

Still another feature relates to the provision of a duct baffle within the vapor treatment zone of generally triangular shape to promote uniform flow to a centrally located outlet duct in the top structure of the vapor treatment section.

A still further feature relates to the provision of means for supplying make-up air to the range unit.

These features cooperate in providing an assembly which is compact and which permits maximum utilization of space while being readily installed and also being highly efficient in operation. The assembly can be readily serviced and cleaned, the parts requiring servicing and cleaning being readily accessible.

This invention contemplates other objects, features and advantages which will become more fully apparent from the following detailed description taken in conjunction with the accompanying drawings.

DESCRIPTION OF A PREFERRED EMBODIMENT

Figure 1:
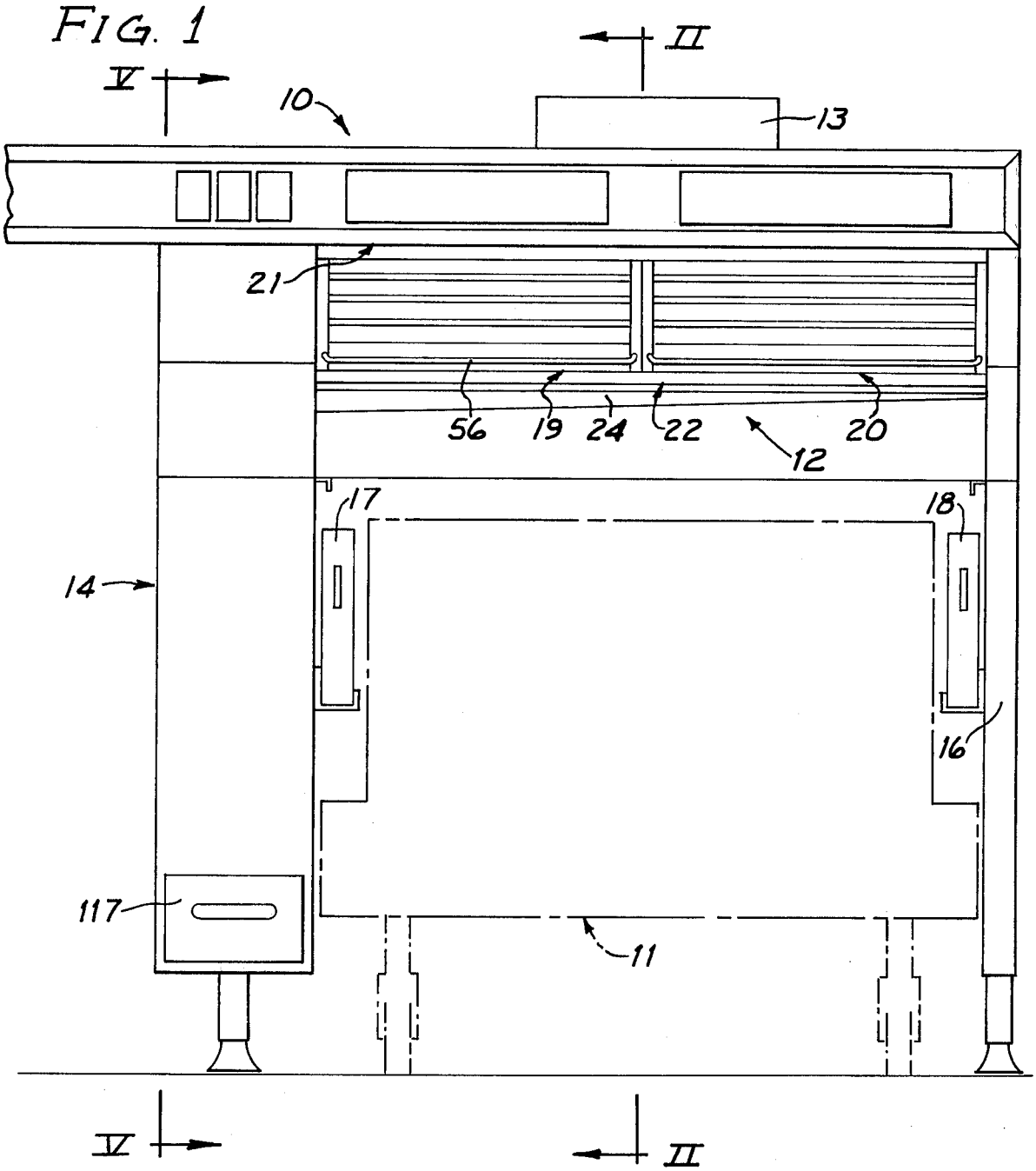
FIG. 1 is a front elevational view of a hood assembly constructed in accordance with the invention.

Reference numeral 10 generally designates a hood assembly constructed in accordance with the principles of this invention. The assembly 10 is designed for operative association with a range unit 11, indicated in broken lines, which may be in the form of a griddle heated by a suitable heat source such as a gas burner and adapted for frying hamburgers or similar foods which generate grease-carrying vapors. Instead of or in addition to a griddle, the range unit might include burners on which frying pans or other utensils might be disposed, or it might include deep-frying units or other cooking means operative to generate hot grease-carrying vapors.

A vapor treating section 12 is disposed over a rearward portion of the range unit 11 and includes means for projecting a water spray through the vapors rising from the range unit to remove grease and other matter therefrom. The section 12 has an outlet duct fitting 13 on its top for connection to a suitable duct to carry treated vapors to an outside vent.

The assembly 10 further includes a water treatment section 14 positioned along one side of the range unit 11 and arranged to receive water from the vapor treatment section 12. The water treatment section 14 includes a tank in which grease coagulates and collects to separate from the water and means for pumping water from the tank back to spray nozzles in the vapor treatment section 12, the water being continuously recirculated.

The vapor and water treatment sections 12 and 14 form a unitary structure with one end of the vapor treatment section being supported over a rearward end portion of the section 14. The other end of the vapor treatment section 12 is supported from the rearward end of a wall section 16 which extends along one side of the range unit 11. Grease pans 17 and 18 are supported on the inner side of the water treatment section 14 and the inner side of the wall 16 for receiving grease scraped from the surface of a griddle.

Important features of the invention relate to the construction and operation of the vapor treatment section 12. In the illustrated arrangement, two baffle sections 19 and 20 are provided which extend downwardly and forwardly from a transverse support structure 21 to a support structure 22 adjacent the forward edge of a trough 24. The rearward portion of the trough 24 is secured to the upper end of a vertical separator wall which is spaced forwardly from a rear vertical wall 26. The space between the separator wall 25 and the rear wall 26 form a passage for flow of flue gases from the range unit when the range unit is of a type using a combustible fuel such as gas as the heat source. An adjustable damper assembly 27 is provided between the upper end of the separator wall 25 and the rear wall 26. A griddle backing or splash plate 28 is shown mounted on the front surface of the wall 25 below the trough 24.

A top wall 30 extends from above the support structure 21 to the upper end of the rear wall 26 with the outlet duct fitting 13 extending from a central portion of the top wall 30. A pair of side walls 31 and 32 are provided, the side wall 31 projecting upwardly from the side of the water treatment section 14 which is closest to the range unit 11 and the side wall 32 projecting upwardly from the rearward portion of the wall section 16.

The space within the boundaries defined by baffle sections 19 and 20, support structures 21 and 22, trough 24, the back wall 26, the top wall 30 and the side walls 31 and 32 form a zone for treatment of hot grease-carrying vapors rising from the range 11 and entering through the baffle sections 19 and 20. Water is sprayed into this treatment zone from a plurality of spray nozzles 33 which project from a pipe 34 extending along the rearward side of the support structure 21 and supported therefrom by suitable brackets 35. The nozzles 33 are preferably arranged to direct a water spray downwardly and forwardly in a direction generally parallel to the baffle sections 19 and 20. An additional pair of nozzles 36 may be provided at opposite ends of the pipe 34 for directing sprays in directions parallel to the axis of the pipe 34.

To prevent the water spray from impinging on the damper assembly 27 and getting into the space between walls 25 and 26, a flue shield 38 is provided extending downwardly and forwardly from the back wall 26 to a point intermediate the upper end of the separator wall 25 and the support structure 22 for the lower edges of the baffle units 19 and 20. The flue gas flows up through the damper assembly 27, then down under the lower end of the shield 38 and then upwardly through the treatment zone.

A duct shield 39 is provided to achieve more uniform flow to the outlet duct fitting 13 and to achieve better treatment of the vapors. The duct shield 39 projects forwardly from the back wall 26 toward the upper end portion of the baffle sections 19 and 20 and the nozzle 33. With the outlet duct fitting being centrally located, the baffle 39 is preferably of generally triangular shape with an apex point 40 aligned with the outlet duct fitting 13 and it is bent along a line extending horizontally upwardly and rearwardly to the back wall to provide two triangularly shaped sections extending angularly from the bend line to the back wall 26 with the ends of such sections being in approximately the same level as the apex point 40.

Important features relate to the construction, mounting and operation of the baffle sections 19 and 20. Both have the same construction and only the section 19 will be described in detail. Baffle section 19 comprises a pair of side frame members 41 and 42 each having inwardly projecting front and rear flange portions and further includes a series of vanes 43–46 having opposite ends welded or otherwise secured to the inner surfaces of such flange portions. Thus vane 43 has a portion 43*a* secured against a flange portion 41*a* of member 41 and a portion 43*b* secured against a flange portion 41*b* of member 41. Vane 43 also has an intermediate portion 43*c* which extends angularly relative to the side frame members 41 and 42 and which is approximately in a horizontal plane in the operative position of the baffle section. Vanes 44–46 are the same as the vane 43 except that the forward portions thereof, corresponding to portion 43*a* of vane 43, may be of reduced width to provide for increased flow through the front with there being a restricted area flow at the rear, increasing the velocity of flow where it enters the treatment zone.

A top cross member 47 is welded or otherwise secured at opposite ends to the upper ends of the side frame members 41 and 42 and has a down-turned forward flange portion 47*a* disposed against the upper part of portion 43*a* of vane 43 and additionally has a rear flange portion 47*b* disposed against part of the portion 43*b* of vane 43.

A pair of bottom cross members 49 and 50 are provided secured at opposite ends to the side members 41 and 42. Member 49 includes a portion 49*a* parallel to the intermediate portions of the vanes and a portion 49*b* at right angles to the portion 49*a* to extend downwardly therefrom. The member 50 includes a portion 50*a* extending upwardly from the lower end of the portion 49*b* in parallel relation to the flanges of the side frame members, a portion 50*b* at right angles to the portion 50*a* and extending forwardly therefrom, a portion 50*c* extending from portion 50*b* and a reversely bent portion 50*d* at the upper end of portion 50*c,* extending over a portion 49*c* of the member 49, extending upwardly from the portion 49*a* thereof.

The portions 50*a* and 50*b* of member 50 form a notch or groove which receives the upper edge of the support structure 22. Support structure 22 is formed by portions 51 and 52 of the trough 24, the portion 51 extending rearwardly and upwardly from the forward end of the trough 24 and the portion 52 extending forwardly and upwardly from the portion 51 at right angles thereto. A bar 53, preferably a wood board of square cross-sectional shape, is secured to an angle member 54 of L-shaped cross-section, one face of the bar 53 being against one leg of member 54 which is secured against the portion 51. The opposite face of the bar 53 is engagable by the ends of spatulas which may be inserted between a spatula support rod 56 and the portion 50*c* of member 50. Rod 56 has opposite in-turned ends secured to the side members 41 and 42 and it extends horizontally with a small spacing distance between it and the portion 50 and with a substantially larger spacing distance to the bar 53. As indicated diagrammatically in broken lines, spatulas 57 and 58 of different lengths may be inserted over the rod 56 to be held with their ends against the bar 53. It may also be noted that the rod 56, in addition to providing a spatula support, also serves as a handle for the baffle section, to facilitate removal thereof and re-insertion after removal and cleaning.

The upper edge portions of the baffle sections 19 and 20 are supported by the support structure 21 which includes a member 60 having a vertical wall portion 60*a,* an upper rearwardly extending flange portion 60*b* secured to the underside of the top wall 30 and a portion 60*c* extending downwardly and forwardly over the rearward upper end of the baffle sections. A second member 61 has a vertical leg 61*a* the upper end portion of which is secured against the portion 60*a* of member 60 and has a forwardly extending leg 61b at its lower end. In addition, a wall portion 62 is provided which extends forwardly from the top wall 30. A front wall portion 63 extends downwardly from the forward end of wall portion 62, a bottom wall portion 64 extends forwardly from the lower end of the front wall portion 63 and is secured to leg 61*b* of member 61 and a flange portion 65 extends downwardly and rearwardly from the rearward end of portion 64 for engagement by the forward surfaces of the baffle sections adjacent the upper ends thereof. Portions 62–65 may preferably be formed integrally with the top wall 30.

It is noted that the upper end portions of the baffle sections 19 and 20 are loosely held between portion 60*c* of member 60 and the flange portion 65 and that there is a clearance distance between the upper ends of the baffle sections 19 and 20 and the wall portion 60*a.* This arrangement permits the baffle sections 19 and 20 to be moved upwardly and forwardly until the lower ends thereof can be pulled forwardly to clear the support structure 22. Thus the baffle sections can be readily removed for cleaning thereof and for access to interior surfaces and the trough 24, for cleaning and maintenance. When the baffle sections are inserted in place, the lower ends thereof rest on the support structure 22, which forms a projection entering into a groove or recess formed by portions 50*a* and 50*b* of the member 50 of baffle section 19, similar portions being provided on the baffle section 20.

Controls for the assembly may be mounted within the space within the wall portions 60*a,* 61*a,* 62, 63 and 64 and the front wall portion 63 may be provided with suitable openings for the mounting of such controls. As shown in FIG. 1, the structure may be extended to one side, to the left in the illustrated arrangement, to extend above work tables or other structures which may be used in conjunction with the range unit in the preparation of food.

The water treatment unit 14 includes a tank 68 having an inlet fitting 69 at its rearward end coupled through an elbow 70, a nipple 71 and a union 72 to a fitting secured to an end portion 24*a* of the trough 24 which projects through the side wall 31. A cover 74 is disposed over the projecting portion 24*b* of the trough 74 and over the drain opening therein.

An outlet fitting 75 of the tank 68 is coupled through a reducer 76, a nipple 77, a union 78 and an elbow 79 to the inlet of a pump unit 80 including an electric drive motor. The outlet of the pump unit 80 is connected through a nipple 81, an elbow 82, a union 83, a nipple 84, a ball valve 85, a pressure gauge 86, a nipple 87, an elbow 88 and a nipple 89 to an elbow secured to the inlet of a line strainer unit 90.

Figure 3:
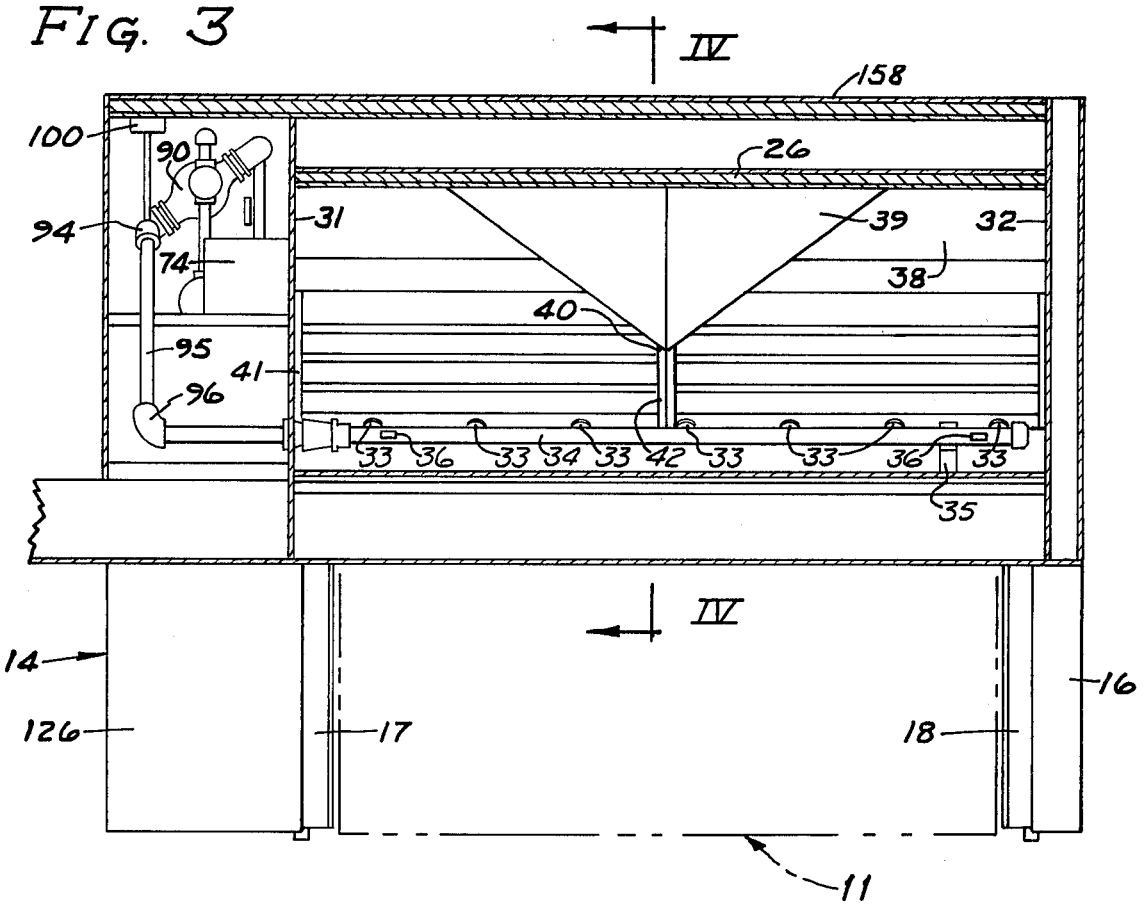
FIG. 3 is a sectional view taken substantially along line III—III of FIG. 2 and showing the arrangement of nozzles in a vapor treatment section.

The outlet of the line strainer unit 90 is connected through an elbow 91, a pipe 92, a T-fitting 93, an elbow 94 and a pipe 95 to an elbow fitting 96 at one end of the nozzle pipe 34, a cap being secured to the opposite end of pipe 34 as shown in FIG. 3.

The T-fitting 93 is connected through a nipple 97 and an elbow 98 to a pressure switch 100 which is connected through suitable electrical circuitry, not shown, to the pump unit 80 and to suitable indicating means such as signal lights mounted in the front wall 63 of the support structure 21.

To insure that there is a proper level of water in the tank 68 at all times, a water supply pipe 102 is connected through an elbow 103, a shut-off valve 104, a nipple 105 and a water pressure reduction valve 106 to a float valve 107 on the inside of the tank 68, valve 107 being controlled by a float 108. An overflow stand pipe 110 is provided inside the tank 68, having a lower end threaded into a fitting 111 with the upper end of a pipe 112 being threaded into the fitting 111 for flow of water to a sewer pipe, not shown.

Means are provided for supplying a suitable liquid detergent into the tank 68 when desired, including a pump unit 114 having an outlet coupled through a tube 115 to the tank 68 and having an inlet coupled through a tube 116 to a detergent tank 117 in the form of a drawer mounted in front of the pump unit 80 and which may be pulled out for checking the level of detergent and for refilling as required. The pump unit 114 may be operated periodically by means of a suitable timer.

The tank 68 includes a bottom wall 120, side walls 121 and 122 and rear and front walls 123 and 124. It is noted that the portion of the water treatment section which encloses the tank 68 is generally rectangular in shape and includes a top wall structure 126 which is removable for access to the tank 68. The upper surface of the top wall structure 126 is at approximately the same level as the upper surface of the range unit and it provides a work surface adjacent thereto for use during the preparation of food.

The tank 68 includes a vertical separator wall 128 dividing the space within the tank into left and right-hand spaces as viewed from the front, drain water from the collection trough being supplied into the rear end of the right-hand space and the water being pumped out from the rearward lower end of the left-hand space which is coupled to the inlet of the pump unit 80.

Figure 8:
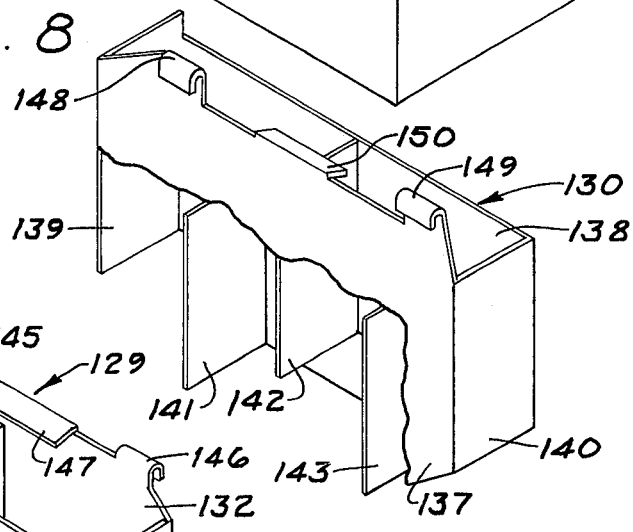
FIG. 8 is an isometric view of a right-hand baffle unit of the water treatment section.
Figure 7:
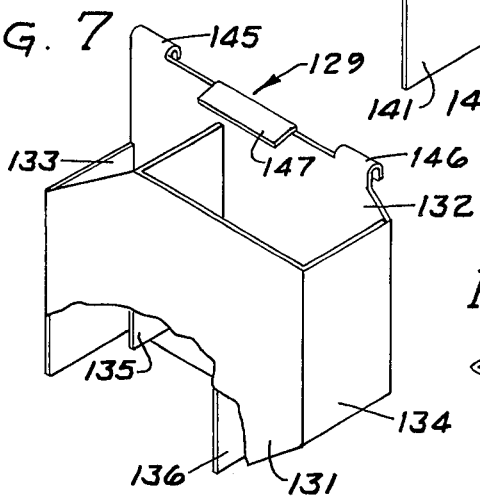
FIG. 7 is an isometric view of a left-hand baffle unit of the water treatment section.

Left and right baffle units 129 and 130 are removably disposable in the tank 68. As shown in FIG. 7, the left unit 129 includes a pair of side walls 131 and 132, a rear wall 133, a front wall 134 and separator walls 135 and 136 parallel to and spaced between the rear and front walls 133 and 134. Similarly, as shown in FIG. 8, the right baffle unit 130 comprises side walls 137 and 138, a rear wall 139, a front wall, and three separator walls 141, 142 and 143. The front and rear walls and the separator walls of both units have substantially the same vertical dimensions but are offset vertically in an alternate fashion such that the water drained from the collection trough and entering the tank at the rear of the right-hand space flows under the rear wall 139 of the right unit 130, then over the wall 141, under the wall 142, over the wall 143, under the front wall 140, then under the front wall 134 of the left unit 129, over the wall 136, under the wall 135 and then over the wall 133 to the space where there is an outlet opening extending to the pump inlet. With this arrangement, the collection of grease coagulating within the tank and the separation from the water is facilitated.

The side wall 132 of the left unit 129 includes a pair of hook portions 145 and 146 engagable in notches in the separator wall 128 and further includes a central lift tab 147 for manual engagement to lift the unit 129 out of the tank. Similarly, the side wall 137 of the right unit 130 includes a pair of hook portions 148 and 149 and a lift tab 150. Thus the baffle units may be readily lifted from the tank for cleaning and to permit grease to be skimmed from the water in the tank.

Figure 9:
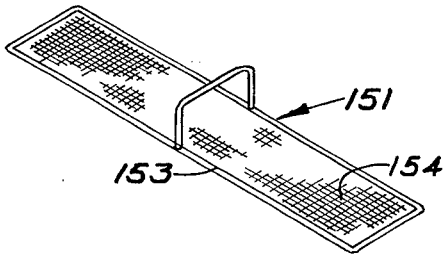
FIG. 9 is an isometric view of a screen usable in the water treatment section.

To further facilitate grease removal, a pair of bottom screens may be disposed in the tank under the baffle units 129 and 130, one of such screens being indicated by reference numeral 151 in FIG. 9. The screen 151 includes a rectangular frame 153 on on which a suitable wire mesh screen material 154 is secured with a lift handle 155 being secured across the central portion of the frame 153. If desired, the screens may be connected to the baffle units to be lifted out when the baffle units are lifted out.

Figure 2:
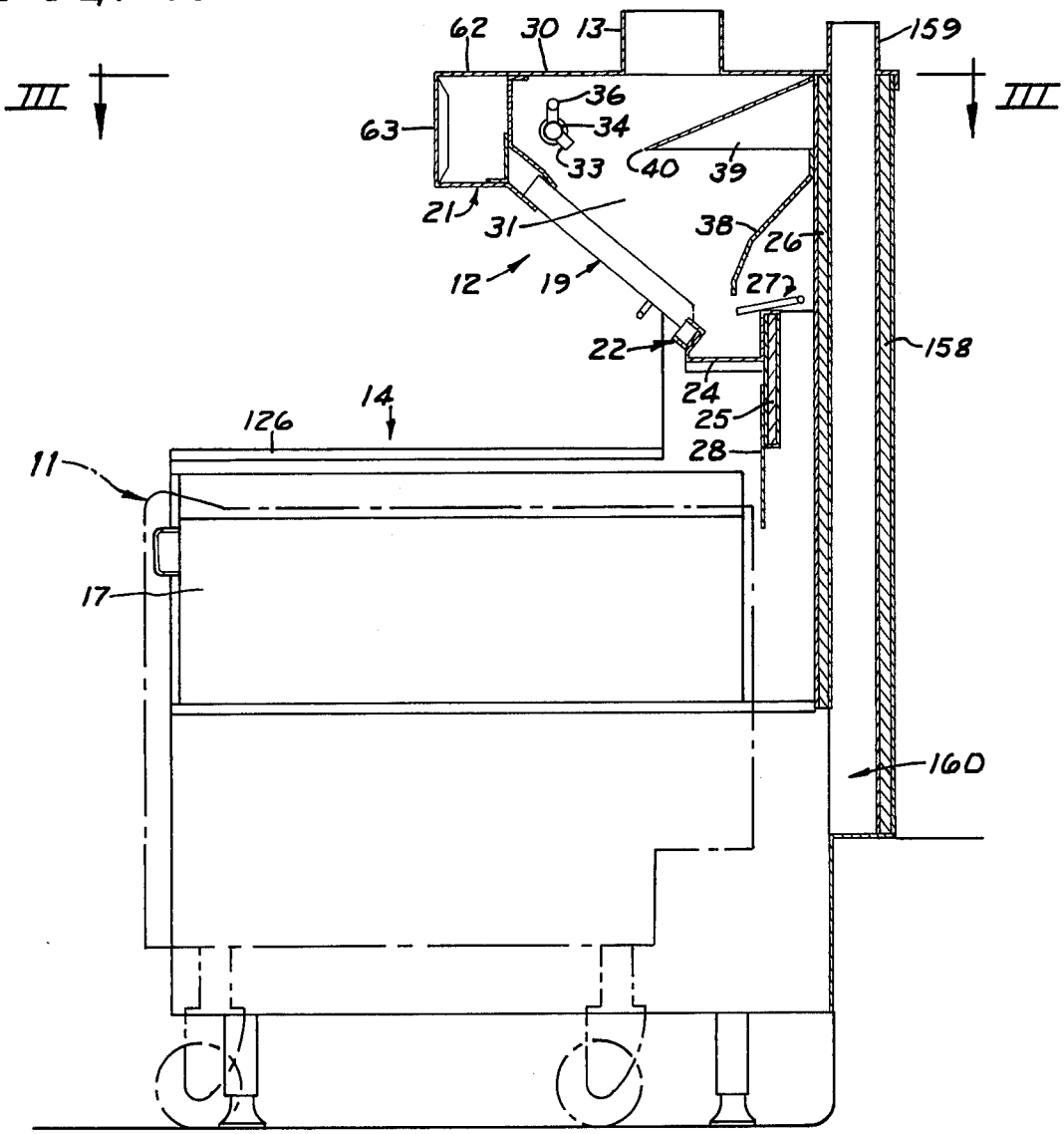
FIG. 2 is a sectional view taken substantially along line II—II of FIG. 1.

It is noted that as shown in FIG. 2, a secondary back wall 158 is preferably provided, spaced behind the back wall 26 and providing a passage for flow of "make-up" air. At the upper end, the top wall 30 is extended over the space between the back wall 26 and the secondary wall 158 and is formed with a duct fitting 159 which may be connected through suitable ducts to a point at which fresh outside air may be drawn in. A fan may be provided for promoting the flow of such air, if desired. At the bottom end, the lower end of the secondary wall 158 is below the lower end of the wall 26 to provide an opening 160 through which the air can flow to the range unit to make-up or replenish air consumed in the combustion of fuel.

It is further noted that both walls 26 and 158 may be filled with a suitable heat-insulating material.

Figure 4:
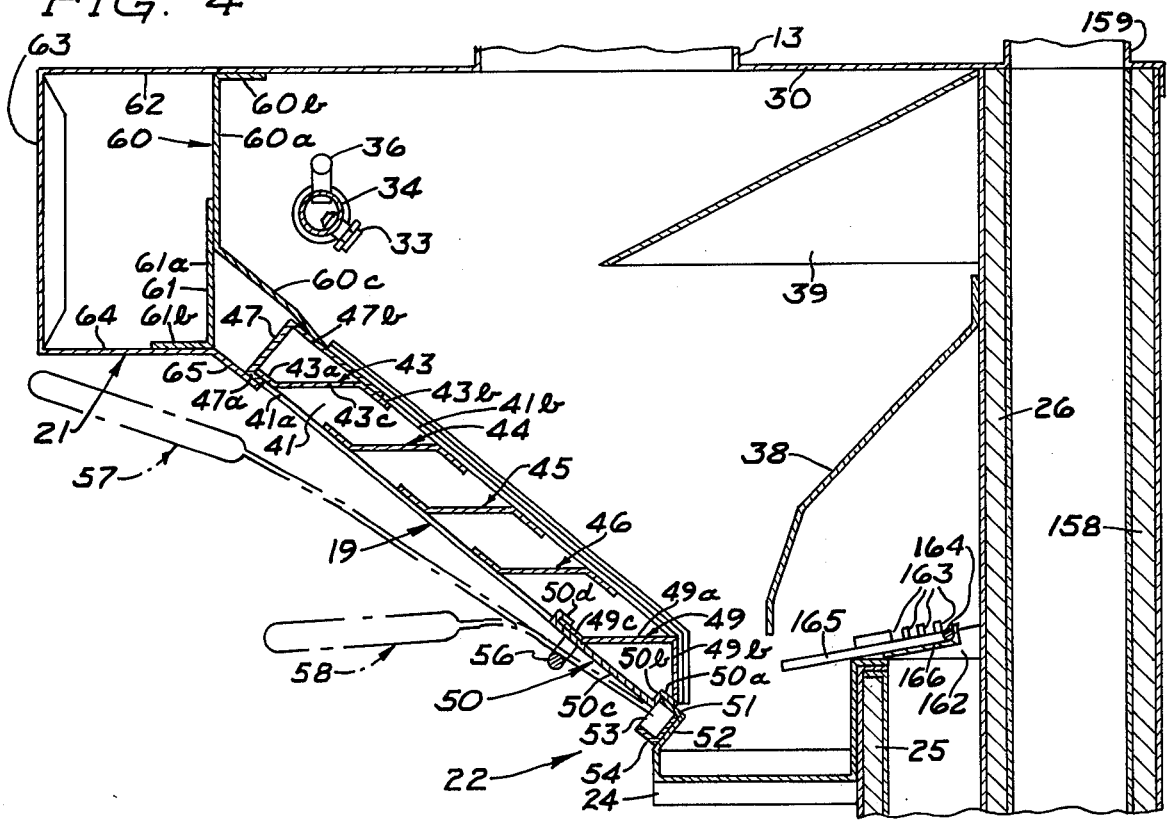
FIG. 4 is a sectional view, on an enlarged scale, taken substantially along line IV—IV of FIG. 3 and particularly illustrating the construction and mounting of a baffle section.
Figure 5:
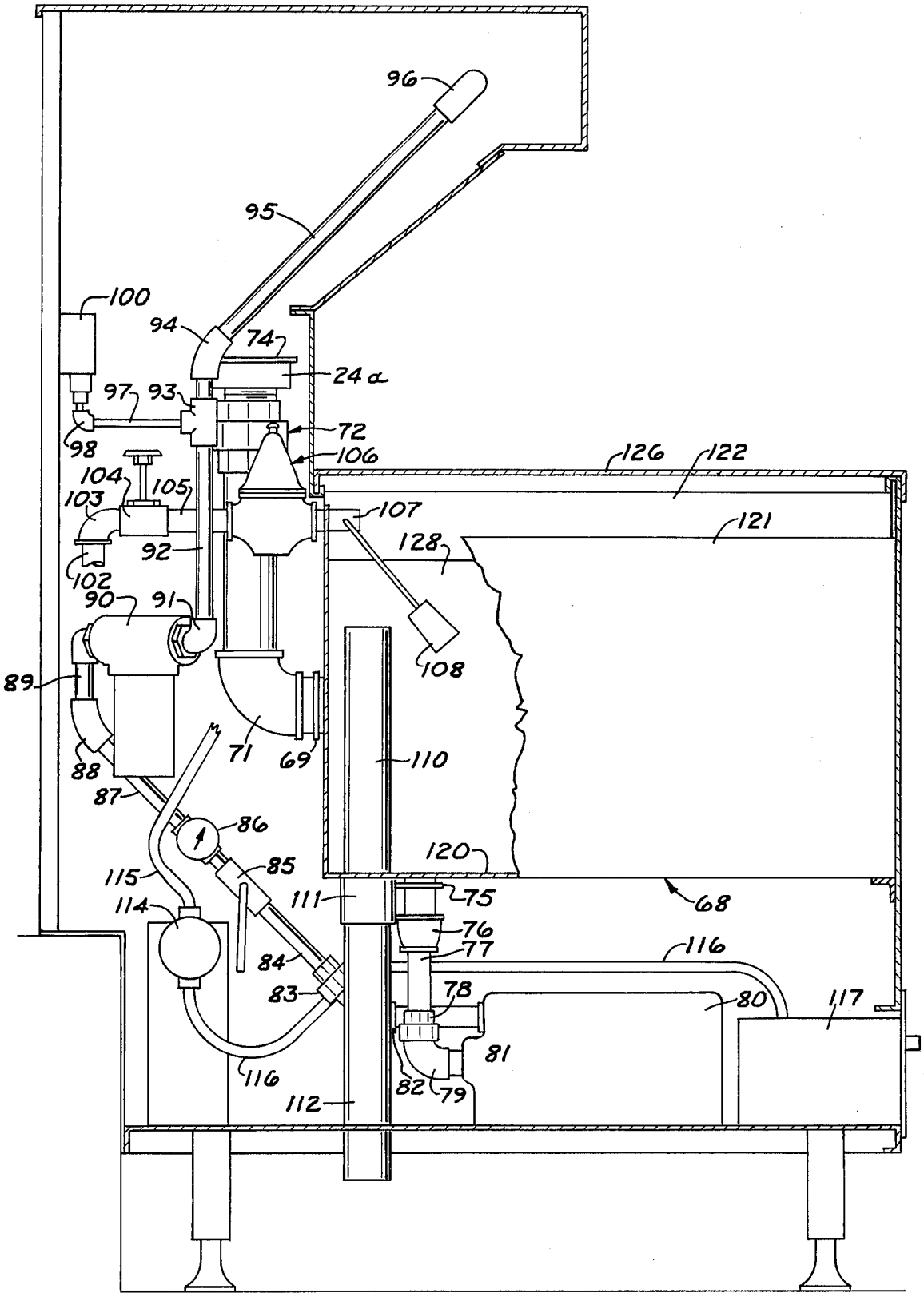
FIG. 5 is a sectional view taken substantially along line V—V of FIG. 1 and showing a water treatment section and a piping arrangement.
Figure 6:
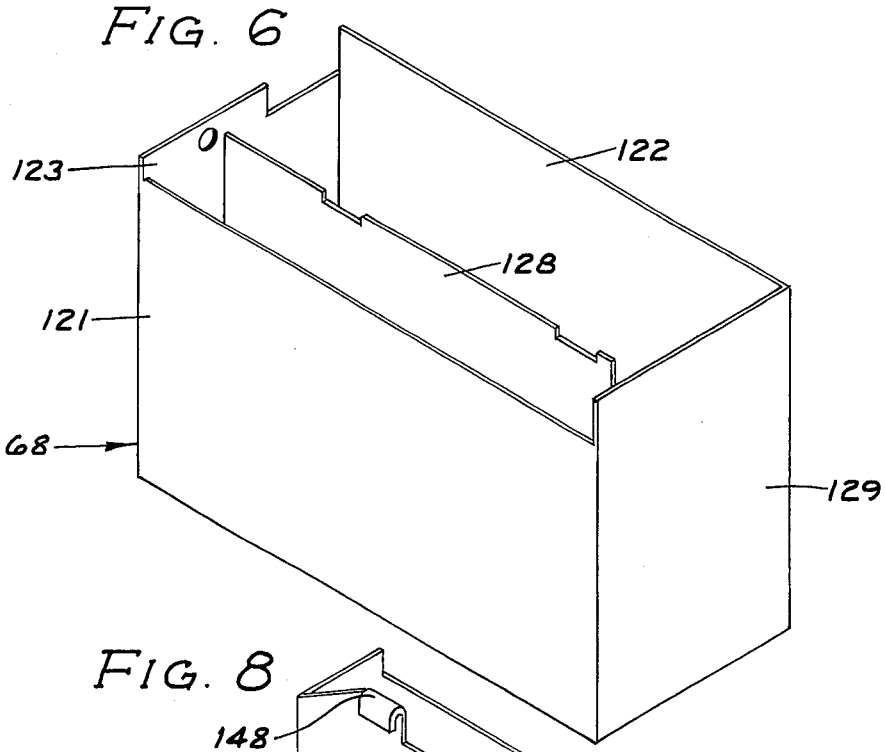
FIG. 6 is an isometric view of a tank of the water treatment section.

The damper assembly 27 comprises a pair of brackets extending between the upper end of the separator wall 25 and the back wall 26, one of the brackets being shown in FIG. 4 and being indicated by reference numeral 162. As shown, the bracket 162 has four spaced notches 163 which selectively receive a pin 164 which is welded or otherwise secured to the end of a rod 165, rod 165 being secured to a plate 166 having an upturned flange portion at its rearward end. By manipulation of the rod 165 and a corresponding rod at the opposite end of the structure, the opening between the rear end of the plate 166 and the back wall 26 may be readily adjusted. It is noted that the damper control rods are readily accessible by lifting the baffle sections 19 and 20 and removing the same, if desired.

There is thus provided a compact unitary assembly which provides maximum utilization of space and which can be readily installed. The baffle sections 17 and 18 provide for free flow of hot grease-carrying vapors into the section 12 while permitting the grease to be efficiently removed through the operation of the nozzles spraying downwardly and forwardly over the baffle sections. The parts are kept cool and fire hazards are minimized. At the same time, the baffle sections 19 and 20 can be readily removed for cleaning thereof and to permit access to interior surfaces, including the trough 24, for servicing and cleaning. The water treatment unit 14 is also readily accessible for servicing and cleaning. The assembly is also relatively simple in construction and economically manufacturable.

It will be understood that modifications and variations may be effected without departing from the spirit and scope of the novel concepts of this invention.

I claim as my invention:

1. In a hood assembly for a range unit supported over a generally rectangular floor space and from which hot grease-containing vapors rise during operation thereof, a unitary structure adapted to be supported adjacent said floor space and comprising: a vapor treatment section for extending over a rearward portion of the range unit and including means defining a vapor treatment zone, spray means for spraying water into said zone, a supply pipe connected to said spray means and having an inlet end at one side of said vapor-treatment section in alignment with one side of said space, and trough means for receiving water sprayed into said treatment zone and having an outlet end at said one side of said vapor treatment section in alignment with said one side of said space, said unitary structure further comprising a water treatment section disposed along said one side of said space and including a generally rectangular housing having a front wall aligned with the front of said space, a pair of side walls with one being aligned with one side of said space and a top wall cover structure for approximate horizontal alignment with the upper surface of the range unit to provide a work surface adjacent thereto, tank means within said housing immediately below said top wall cover structure and extending rearwardly from said front wall of said housing between said side walls thereof, first conduit means extending downwardly from said outlet end of said trough means to said tank means for gravity flow of grease-carrying water from said trough means down into said tank means for separation by flotation of lower density grease from higher density water, pump means having an inlet and an outlet, second conduit means coupling said pump means inlet to a lower point of said tank means below the level of grease therein, and third conduit means coupling said pump means outlet to said inlet end of said supply pipe for flow of water to said spray means, said top wall cover structure being movable for access to said tank means, removal of grease therefrom and cleaning and service thereof.

2. In an assembly as defined in claim 1, said tank means being generally rectangular and having front, rear and bottom walls and a pair of side walls, a separator wall parallel to and spaced between said side walls and having a rear edge disposed against said rear wall, a bottom edge disposed against said bottom wall and a front edge spaced from said front wall, said first conduit means being coupled to the rear portion of a first space located between said separator wall and one of said side walls, and said second conduit means being coupled to the rear part of a second space located between said separator wall and the other of said side walls, a pair of baffle structures disposed in said tank means in said first and second spaces each including a plurality of baffle walls, said baffle walls all having substantially the same vertical dimension and being alternately offset vertically for flow of grease-carrying water in a tortuous path progressively under one baffle wall, over the next baffle wall, then under the next baffle wall and so on.

3. In an assembly as defined in claim 2, said pair of baffle structures having means to be lifted out of said tank means for cleaning thereof.

4. In an assembly as defined in claim 3, screen means on said tank bottom wall below said baffle structures having means to be lifted out for grease removal.

5. In an assembly as defined in claim 1, a support wall supporting the side of said vapor treatment section opposite the aforesaid one side thereof and having a forward end aligned with said front wall of said housing.

6. In a hood assembly as defined in claim 1, said pump means being disposed below a rearward portion of said tank means.

7. A hood assembly as defined in claim 6, drawer means mounted in said housing below said tank means and in front of said pump means and defining a detergent tank, and additional pump means for periodically supplying detergent from said drawer means into said tank means.

8. In a hood assembly for a range unit supported over a generally rectangular floor space and from which hot grease-containing vapors rise during operation thereof, a vapor treatment section including generally rectangular top wall means in vertical alignment with a rearward portion of said space, a pair of side wall means extending downwardly from said top wall means in alignment with the sides of said space, rear wall means extending downwardly from the rear side of said top wall means, trough means supported in front of said rear wall means at a level spaced a substantial distance below said top wall means, first baffle support means extending downwardly from the front side of said top wall means, second baffle support means adjacent the front side of said trough means, baffle means extending angularly downwardly and rearwardly from said first baffle support means to said second baffle support means, said side and rear wall means and said baffle and baffle support means defining a vapor treatment zone, and spray means for spraying water through vapors within said zone, said baffle means having openings therethrough and being arranged for permitting free flow of vapors into said treatment zone while directing flow of water impinged thereon into said trough means, said baffle means comprising a plurality of spaced parallel horizontally extending vanes each including a generally horizontal portion, a rearward portion projecting angularly downwardly and rearwardly from the rearward edge of said horizontal portion to a rearward terminal edge spaced above the horizontal portion of the next lower vane and a forward portion projecting upwardly and forwardly from the forward edge of said horizontal portion to a forward terminal edge spaced below the horizontal portion of the next higher vane.

9. In an assembly as defined in claim 8, said baffle means having means for manually removal forwardly away from said treatment zone for cleaning thereof and for access to said trough means and interior surface portions of said wall means for cleaning thereof.

10. In an assembly as defined in claim 9, said baffle means including at least one generally rectangular baffle section having top, bottom and side edge portions, projection and recess means on said bottom edge portion and said second baffle support means adapted to interfit when said bottom edge portion rests on said second baffle support means to limit forward and rearward movement of said baffle section, and said first baffle support means being arranged to allow upward movement of said baffle section to disengage said projection and recess means and to allow said baffle section to be removed downwardly and forwardly.

11. In an assembly as defined in claim 8, said spray means comprising a generally horizontal pipe behind said first baffle support means and adjacent said top wall means, and a plurality of nozzles at spaced positions along said pipe for spraying water rearwardly and downwardly into said treatment zone above said baffle means.

12. In an assembly as defined in claim 11, a pair of additional nozzles at opposite ends of said pipe inside said side wall means and each arranged to direct a spray in a direction toward the opposite side wall means.

13. In an assembly as defined in claim 8, said top wall means having an outlet duct opening for flow of treated vapors upwardly therefrom, said outlet duct opening being centrally located at a substantial distance from both of said side wall means, a generally triangularly shaped duct shield having a rearward edge secured to said rear wall means and extending substantially to said side wall means and having a forward apex point positioned below said outlet duct opening.

14. In a hood assembly for a range unit supported over a generally rectangular floor space and from which hot greasecontaining vapors rise during operation thereof, a vapor treatment suction including generally rectangular top wall means in vertical alignment with a rearward portion of said space, a pair of side wall means extending downwardly from said top wall means in alignment with the sides of said space, rear wall means extending downwardly from the rear side of said top wall means, trough means supported in front of said rear wall means at a level spaced a substantial distance below said top wall means, first baffle support means extending downwardly from the front side of said top wall means, second baffle support means adjacent the front side of said trough means, baffle means extending angularly downwardly and rearwardly from said first baffle support means to said second baffle support means, said side and rear wall means and said baffle and baffle support means defining a vapor treatment zone, spray means for spraying water through vapors within said zone, said baffle means having openings therethrough and being arranged for permitting free flow of vapors into said treatment zone while directing flow of water impinged thereon into said trough means, generally vertical separator wall means behind said trough means and spaced forwardly from said rear wall means to define a passage for upward flow of flue gases from a range unit toward said vapor treatment zone, and flue gas shield means extending angularly downwardly and forwardly from said rear wall means to a forward edge spaced forwardly with respect to the plane of said separator wall means.

15. In an assembly as defined in claim 14, for a range unit having heating means utilizing a combustible fuel, secondary rear wall means supported in spaced relation behind said rear wall means of said vapor treatment section to define a passage for receiving outside air into its upper end and open at its lower end to supply air to the range unit to replenish air consumed by combustion.

* * * * *